US006719665B1

(12) United States Patent
Lai

(10) Patent No.: US 6,719,665 B1
(45) Date of Patent: Apr. 13, 2004

(54) STEP SIMULATOR HAVING PACE ADJUSTMENT DEVICE

(76) Inventor: Fen-Ying Lai, P.O. Box 697, Feng-Yuan City, Taichung Hsien (TW), 420

( * ) Notice: Subject to any disclaimer, the term of this patent is extended or adjusted under 35 U.S.C. 154(b) by 0 days.

(21) Appl. No.: 10/323,778

(22) Filed: Dec. 20, 2002

(51) Int. Cl.[7] ..... A63B 22/04

(52) U.S. Cl. ..... 482/52; 482/57; 482/62

(58) Field of Search ..... 482/51, 52, 53, 482/57, 58, 59, 62, 63, 64, 65, 908

(56) References Cited

U.S. PATENT DOCUMENTS 5,766,113 A * 6/1998 Rodgers, Jr. ..... 482/52
5,846,166 A * 12/1998 Kuo ..... 482/52
6,077,196 A * 6/2000 Eschenbach ..... 482/51
6,422,977 B1 * 7/2002 Eschenbach ..... 482/52
6,482,132 B2 * 11/2002 Eschenbach ..... 482/52

OTHER PUBLICATIONS

Tobias, Exercise Device, Pub. No. US 2002/0137601, Sep. 26, 2002.*
Stearns et al. Exercise Apparatus with Elliptical Foot Motion, U.S. Pub. No. US 2002/0151411, Oct. 17, 2002.*
Eschenbach, Pathfinder Elliptical Exercise Machine, U.S. Pub. No. 2002/0019298.*

* cited by examiner

*Primary Examiner*—Nicholas D. Lucchesi
*Assistant Examiner*—Tam Nguyen

(57) ABSTRACT

A step simulator having pace adjustment device includes a stand, a driving wheel and a idler wheel rotatably secured to the stand and connected by a belt, a pair of tread bars indirectly pivoted to a pair of cranks of the driving wheel via a pair of adjustment devices, a pair of support rods respectively pivoted to a connecting bars of the adjustment devices and a transverse rod on a post of the stand and a pair of handle bars secured to the top of the support rods respectively. This disclosure is characterized in the pair of adjustment devices by which the step simulator is compact in size and both the oscillatory range of the tread bars and the length of the pace are adjustable in order that the step simulator enables to serve the adults and/or the children.

2 Claims, 7 Drawing Sheets

STEP SIMULATOR HAVING PACE ADJUSTMENT DEVICE

BACKGROUND OF THE INVENTION

The present invention relates to step simulators and more particularly to a step simulator having pace adjustment device which can reduce the oscillatory range of the elliptic orbit movement for the tread bars in order to adjust the step pace and to contract the size for the step simulator.

A prior art step simulator 10 (as shown in FIG. 1) comprises a L-shaped stand 11, a driving wheel 15 and a belt wheel 16 pivoted on several connecting bars 12, 13 and 14. The driving wheel 15 drives the belt wheel 16 via a belt 151 and has a crank 17 on each lateral side to respectively pivot a pair of tread bars 171 each of which has a pedal 18 on the top and a caster 172 on rear end. When treads the tread bars 171 with appropriate strength, the tread bars 171 begin to rotate up and down on the cranks 17 and the pedals 18 move along with an elliptic orbit so as to obtain effective physical exercises for an operator. For reducing the rotation speed of the driving wheel 15, the belt wheel 16 is indispensable in this step simulator 10. So that the size of this step simulator 10 is therefore enlarged causing inconvenience to pack for transportation.

Furthermore, the tread bars 171 are directly pivoted to the cranks 17 which rotate along with the circumference of a large circle so as to cause the vertical oscillatory range of the tread bars 171 and the feet of the operator too large to compare with that a man walks on the ground.

The feet of the operator too large to compare with that a man walks on the ground. For example the patents of the U.S. Pat. No. 5,938,567, U.S. Pat. No. 5,924,962, U.S. Pat. No. 5,813,949, U.S. Pat. No. 5,573,480 and U.S. Pat. No. 5,540,637 also is such.

SUMMARY OF THE PRESENT INVENTION

The present invention has a main object to provide a step simulator having pace adjustment device which reduces the vertical oscillatory range for the pace to enable the exercises of an operator more like that a man walks on the ground.

Another object of the present invention is to provide a step simulator having pace adjustment device which device can adjust the step length in order that the step simulator can serve both the adults and children.

Further object of the present invention is to provide a step simulator having pace adjustment device which the step simulator is in compact size to facilitate packing for transportation and requires a small space to place it.

The present invention will become more fully understood by reference to the following detailed description thereof when read in conjunction with the attached drawings.

DETAILED DESCRIPTION OF THE PREFERRED EMBODIMENT

Figure 1:
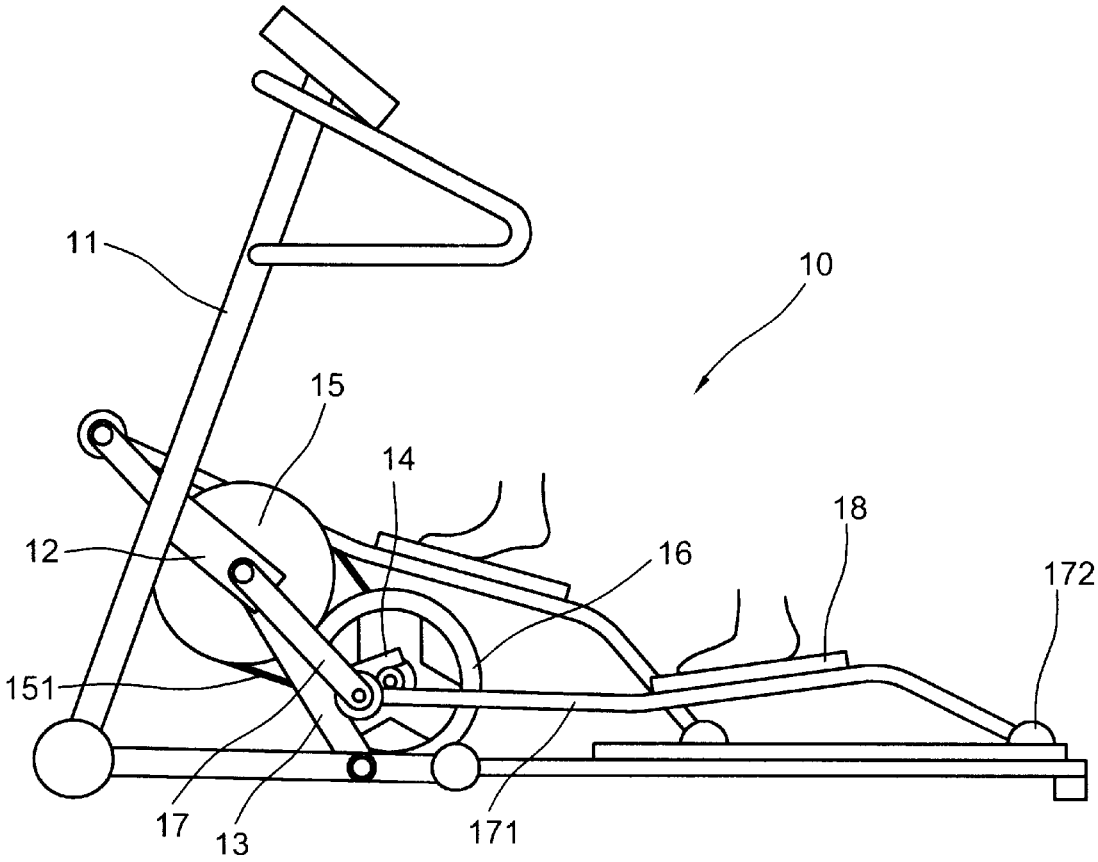
FIG.1 Prior Art
FIG. 1 is a side view of a step simulator according to a prior art.
Figure 2:
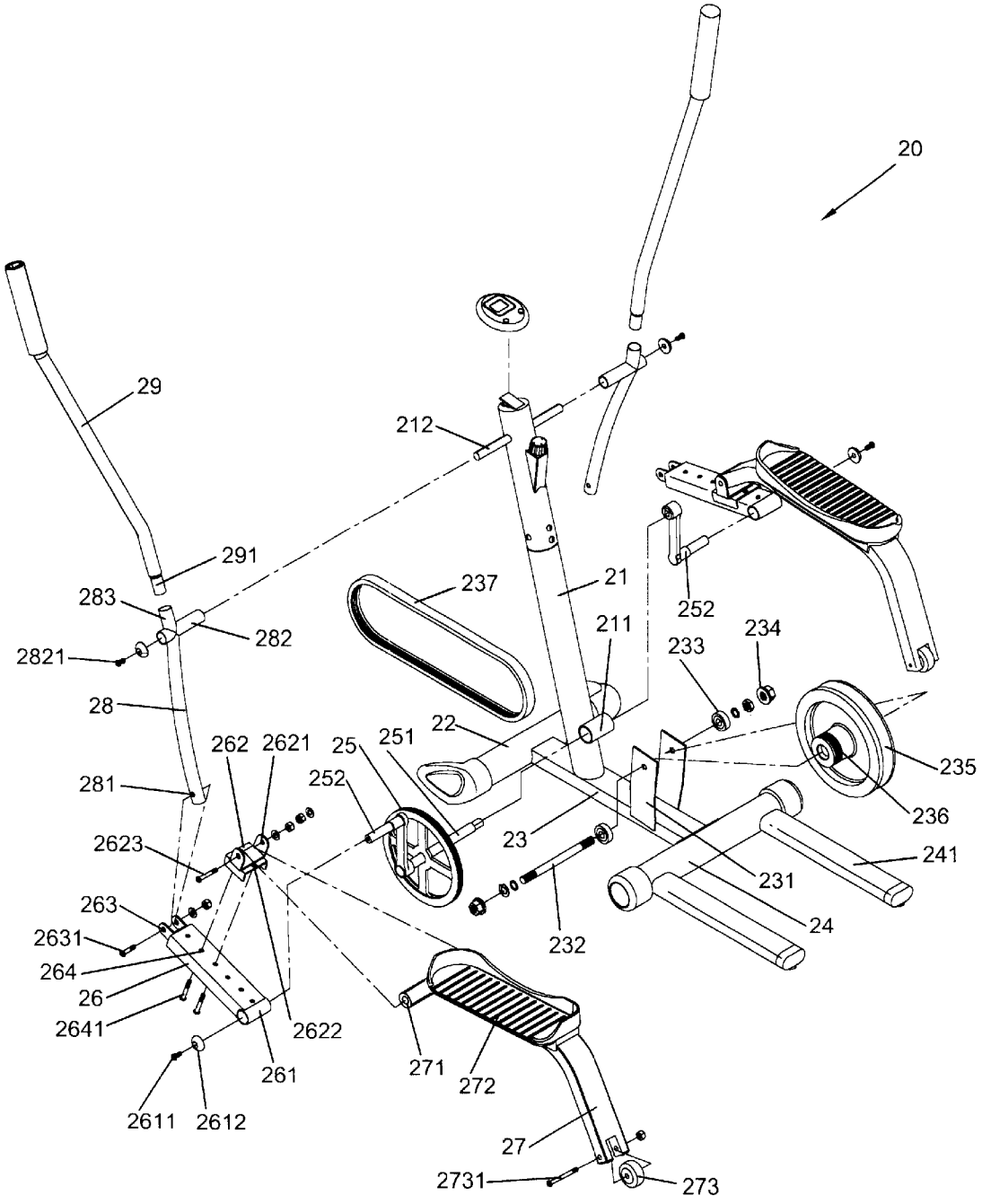
FIG. 2 is an exploded perspective view of a step simulator according to the present invention.
Figure 3:
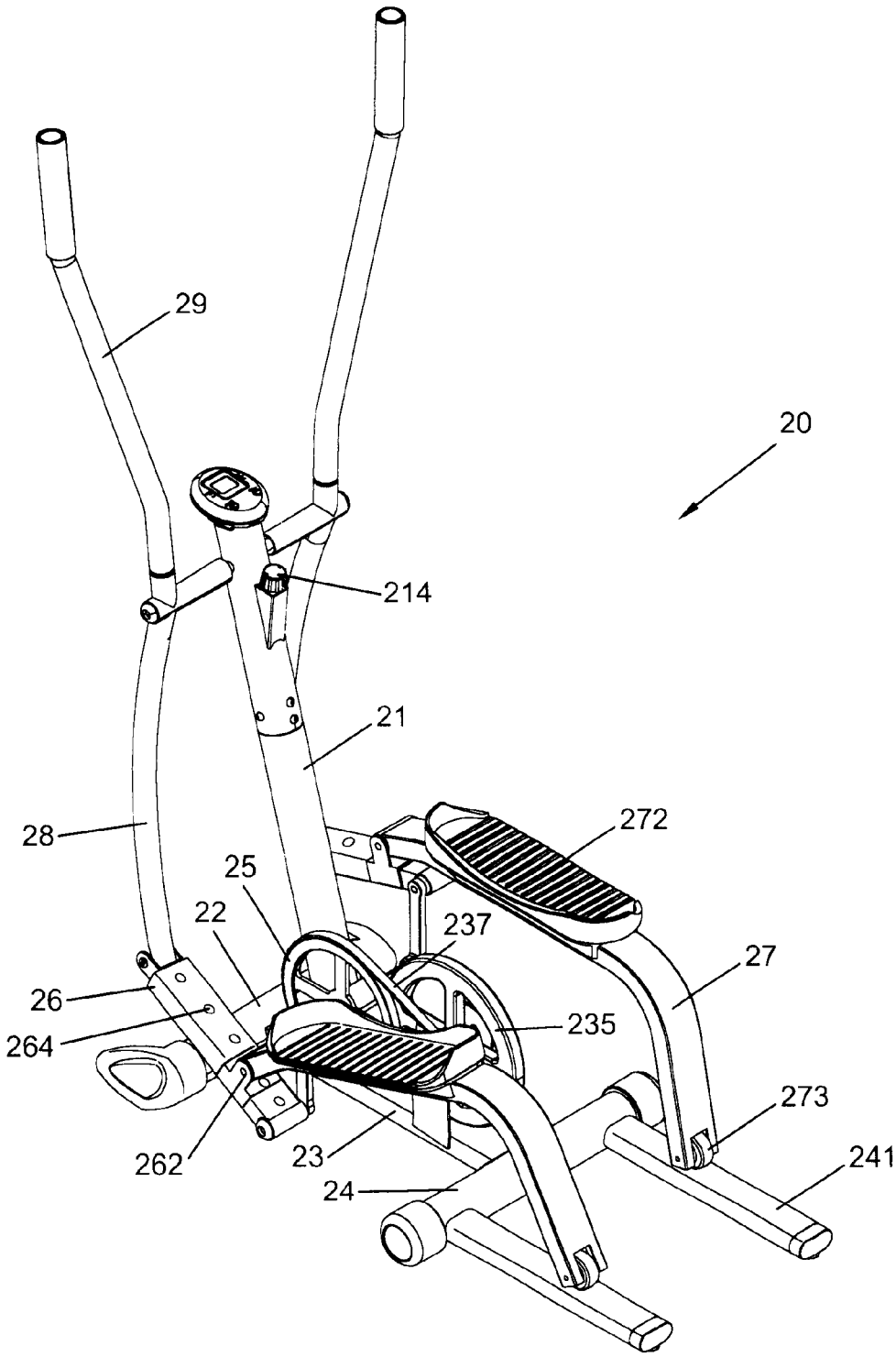
FIG. 3 is a perspective view to show the assembly of FIG. 1.
Figure 4:
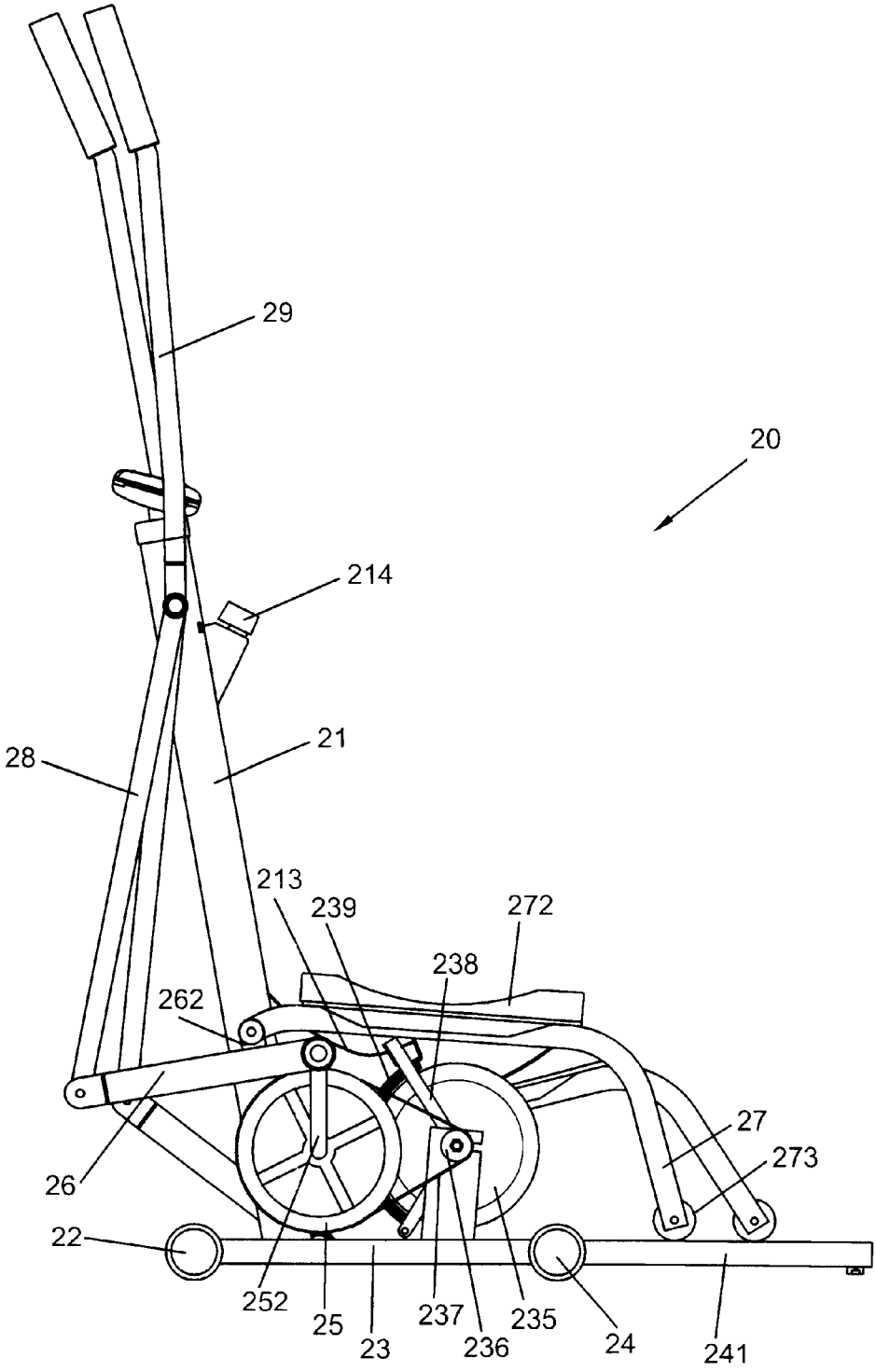
FIG. 4 is a side view of FIG. 3.

With reference to FIGS. 2, 3 and 4 of the drawings, the step simulator having pace adjustment device 20 of the present invention comprises a stand which is composed of a front foot bar 22, a rear foot bar 24 perpendicularly connected on their middle portion by a cross bar 23, a post 21 projected upward from a front upper surface of the cross bar 23 including a transverse tube 211 on lower inner periphery and a transverse rod 212 perpendicularly across the upper portion, a pair of upright plates 231 each having a through hole in upper portion spacedly projected upward from a rear portion of the cross bar 23 and a pair of guide bars 241 spacedly extended rearward from a rear periphery of the rear foot bar 24, a driving wheel 25 which has an axis 251 rotatably inserted through the transverse tube 211 of the post 21 and a pair of cranks 252 symmetrically secured to two ends of the axis 251, an idler wheel 235 including a belt wheel 236 on one side rotatably secured to the through holes of the upright plates 231 by a spindle 232 and nuts 234 with bearings 233 engaged therebewteen, a belt 237 wrapped on the driving wheel 25 and the belt wheel 236 for making the belt wheel 236 to be rotated in concert with the driving wheel 25, a pair of pace adjustment devices each of which is comprised of a connecting bar 26 and an adjustment member 262 wherein the connecting bar 26 each has a tube 261 on rear end rotatably secured to the cranks 252 of the driving wheel 25 respectively by bolts 2611 and washers 2612, a lug 263 on the front end and a plurality of positioning holes 264 spacedly and centrally formed in the body along the length thereof for selectively secured the adjustment member 262 each of which has a lug 2621 on the top and a pair of screw holes in the bottom engaged with the positioning holes 26 and secured by bolt 2641, a pair of arcuate tread bars 27 each of which has a tube 271 on front end respectively pivoted to the lugs 2621 of the adjustment member 262 by bolts 2623 and nut with washers engaged therebetween, a pedal 272 on the top and a caster 273 rotatably secured to the downward curved end and slidably on the pair of guide bars 241 respectively, a pair of support rods 28 each having an aligned through hole 281 adjacent lower end respectively pivoted to lug of the connecting bars 26 and secured by bolts 2631 and nuts, a transverse tube 282 adjacent the upper end rotatably secured on the transverse rod 212 and secured by bolts 2821 and an opening 283 in the top for securing a reduced lower end 291 of a pair of handle bars 29, a pair of positioning rods 238 on the lateral sides of the idler wheel 235 for positioning a magnet controlled resistance member or brake 239 which is adjustably controlled by a rope 213 and a swivel button 214 to provide appropriate resistant force to the idler wheel 235 (as shown in FIG. 4).

Based on the afore discussed structure, in operation, the operator's feet stand on the pedals 272 and hands grasp the handle bars 29 and exert appropriate strength on the tread bars 27 in addition to his own weight, then the driving wheel 25 begins to rotate. Due to the idler wheel 235 and the magnet controlled resistance member, the rotation speed of the driving wheel 25 is adjustable. The adjustment devices reduce the vertical oscillatory range on the front end of the tread bars 27 and the feet of the operation move in concert with pedals 272 along with an elliptic orbit which is more like that a man walks on the ground. Since the adjustment device can adjust the length of the pace, this step simulator can serve both the adults and the children.

Figure 5:
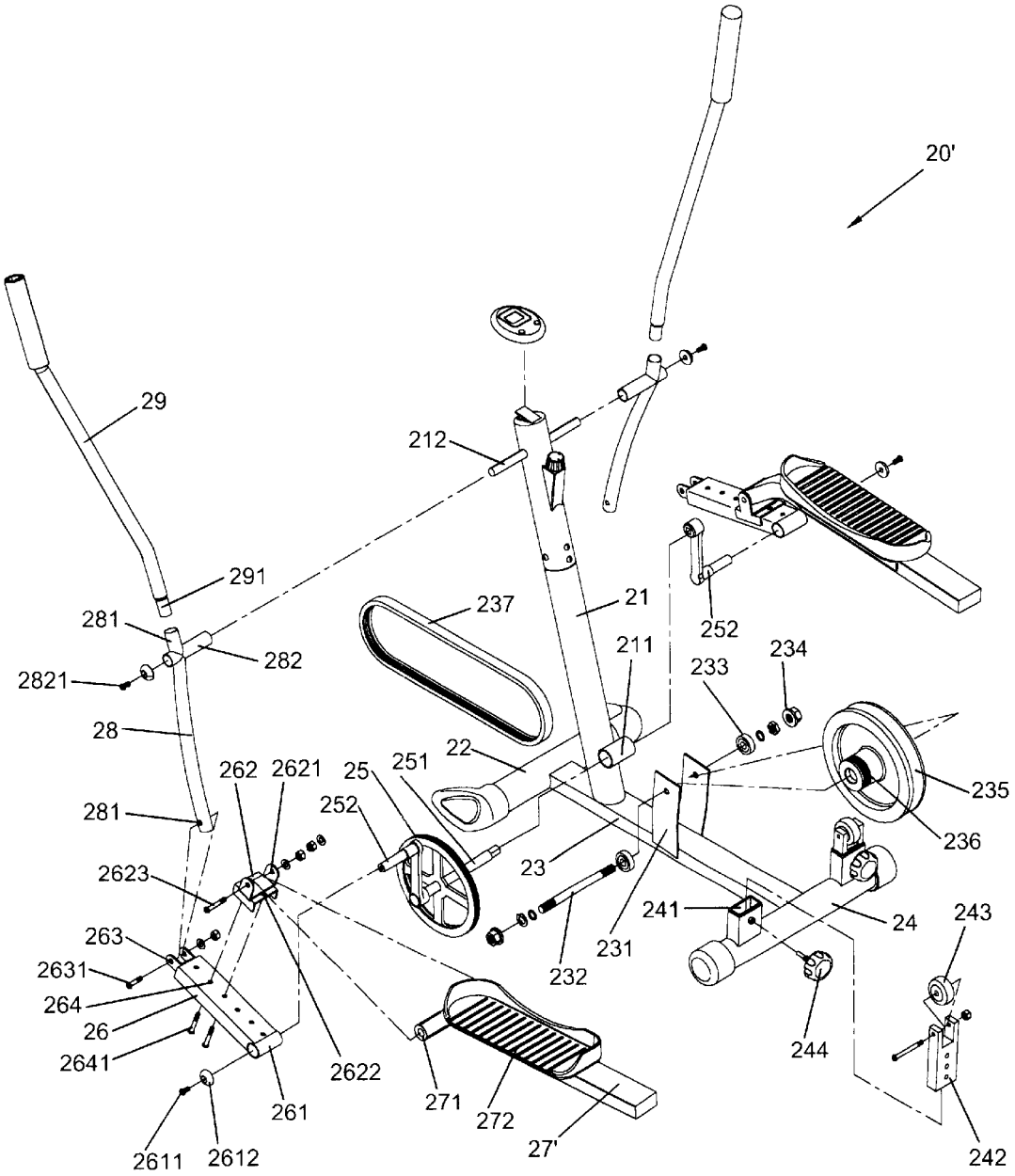
FIG. 5 is an exploded perspective view of an alternate embodiment of the step simulator according to the present invention.
Figure 6:
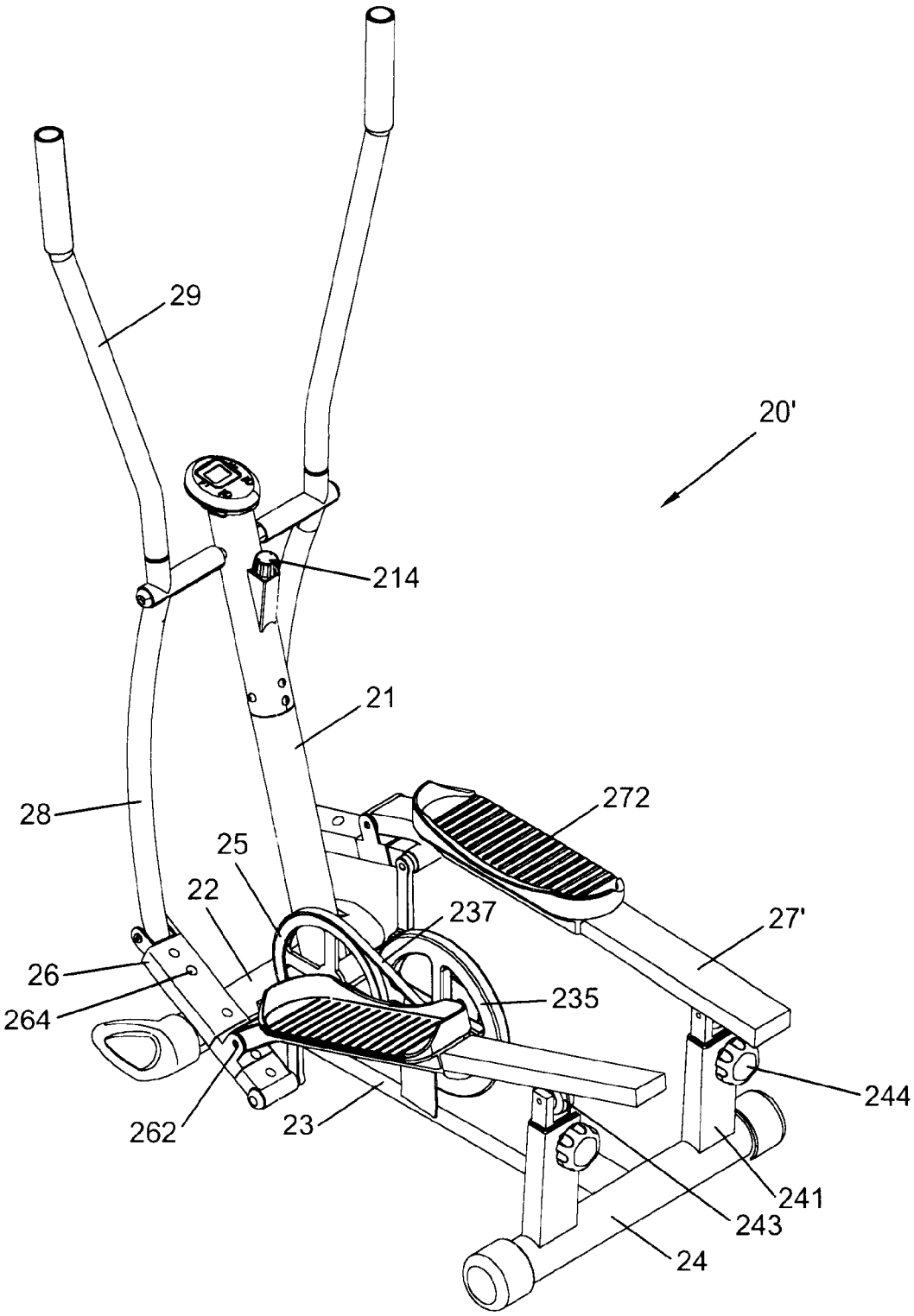
FIG. 6 is a perspective view to show the assembly of FIG. 5.
Figure 7:
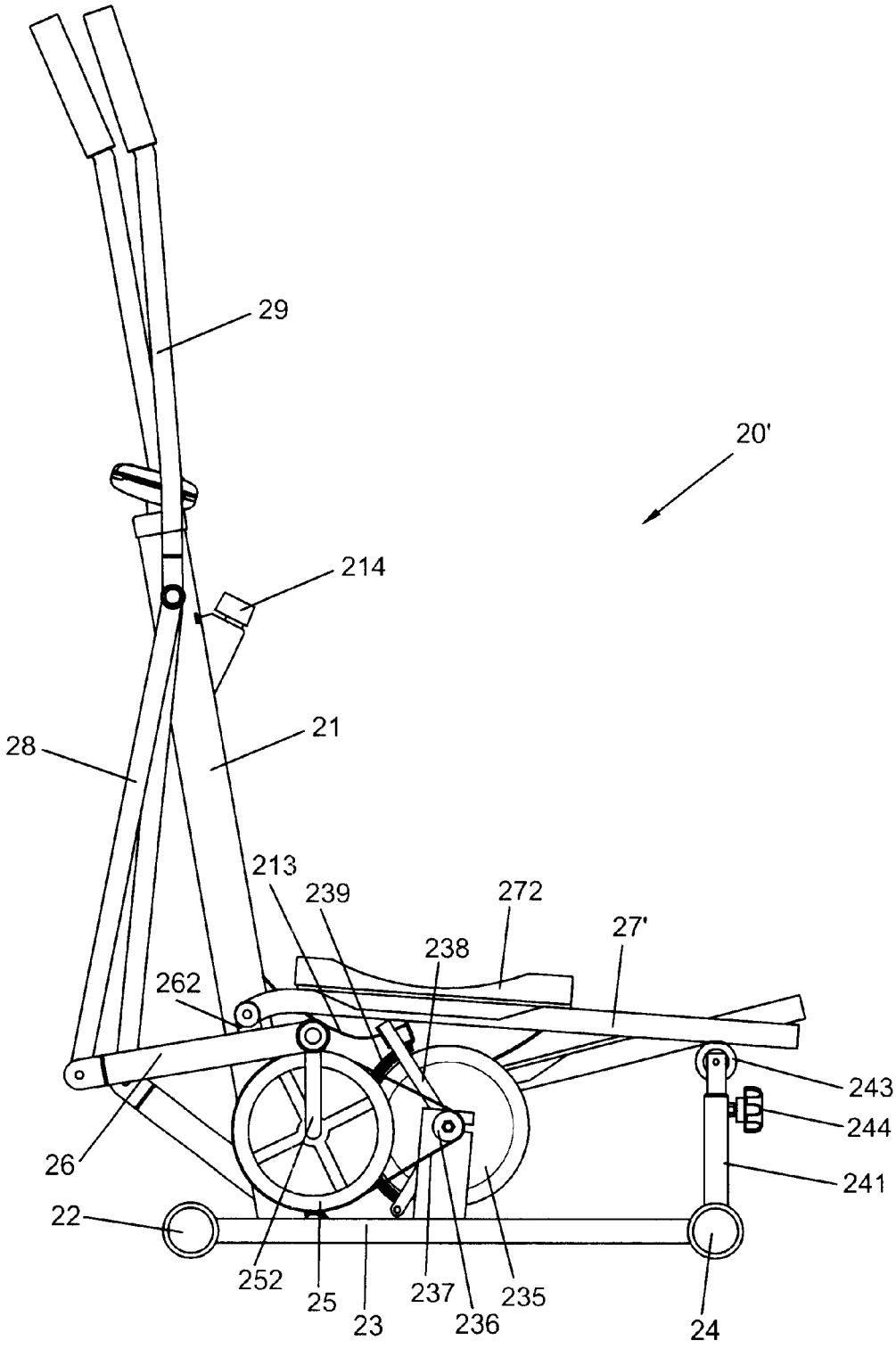
FIG. 7 is a side view of FIG. 6.

Referring to FIGS. 5, 6 and 7, an alternate embodiment is provided. This embodiment is structurally and functionally most similar to the above embodiment as described in FIGS. 2 to 4 and the above discussions are applicable in the most instances. The only difference is that the pair of guide bars 241 are replaced with a pair of housings 242 spacedly projected upward from the top of the rear foot bar 24, a pair of adjustable racks 242 respectively dispose into the housings 242 each including a caster 243 on the top and a pair of swivel buttons 244 respectively secure the adjustable racks 242 and adjust the height of the adjustable racks 242, and the arcuate tread bars 27 are replaced with a pair of straight tread bars 27' which slide on the top of the casters 244. Upon these modifications, the step simulator of the present invention becomes more compact in size.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A step simulator having pace adjustment device comprising:

a stand which is composed of a front foot bar, a rear foot bar perpendicularly connected on their middle portions by a cross bar, a post projected upward from a front upper surface of said cross bar, a first transverse tube on lower inner periphery of said post, a transverse rod perpendicularly across an upper portion of said post, a pair of upright plates each having a through hole in upper portion spacedly projected upward from a rear portion of said cross bar and a pair of guide bars spacedly extending rearward from a rear periphery of said rear foot bar;

a driving wheel having an axis rotatably inserted through said first transverse tube of said post and a pair of cranks symmetrically secured to two ends of said axis respectively;

an idler wheel including a belt wheel on one side rotatably secured to the through holes of said upright plates by a spindle and nuts with bearings engaged therebetween;

a belt wrapped on said driving wheel and said belt wheel;

a pair of pace adjustment devices each of which includes a connecting bar and an adjustment member, said connecting bar having a first tubular means on rear end respectively engaged with the cranks of said driving wheel, a first lug on front end and a plurality of positioning holes spacedly and centrally from in the body along the length thereof, said adjustment member having a second lug on top and a pair of screw holes in bottom for selectively secured said adjustment member to the positioning holes of said connecting bar by bolts;

a pair of arcuate tread bars each having a second tubular means on front end pivoted to the second lug of said adjustment members by bolts and nuts with washers engaged therebetween, a pedal on top and a caster rotatably secured to a downward curved end, said casters being slid on the pair of guide bars of said stand respectively;

a pair of support rods each having an aligned through hole adjacent lower end respectively pivoted to the first lug of said connecting bars and secured by bolts and nuts with washers engaged therebetween, a second transverse tube adjacent upper end respectively engaged with the transverse rod of said post and an opening in top thereof;

a pair of handle bars each having a reduced lower end secured to the opening of said support rods respectively;

a pair of positioning rods disposed on lateral sides of said idler wheel for positioning a magnet controlled resistance member which is adjustably controlled by a rope and a swivel button on said post.

2. A step simulator having pace adjustment device comprising:

a stand which is composed of a front foot bar, a rear foot bar perpendicularly connected on their middle portions by a cross bar, a post projected upward from a front upper surface of said cross bar, a first transverse tube on lower inner periphery of said post, a transverse rod perpendicularly across an upper portion of said post, a pair of upright plate each having a through hole in upper portion spacedly projected upward from a rear portion of said cross bar, a pair of housings spacedly projected upward from upper surface of said rear foot bar, a pair of adjustable racks each having a caster on top respectively disposed into said housings and adjustably secured by a pair of fist swivel buttons respectively;

a driving wheel having an axis rotatably inserted through said first transverse tube of said post and a pair of cranks symmetrically secured to two ends of said axis respectively;

an idler wheel including a belt wheel on one side rotatably secured to the through holes of said upright plates by a spindle and nuts with bearings engaged therebetwen;

a belt wrapped on said driving wheel and said belt wheel;

a pair of pace adjustment devices of which including a connecting bar and an adjustment member, said connecting bar having a first tubular means on rear end respectively engaged with the cranks of said driving wheel, a first lug on front end and a plurality of positioning holes spacedly and centrally formed in the body along the length thereof, said adjustment member having a second lug on top and a pair of screw holes in bottom for selectively secured said adjustment member to the positioning holes of said connecting bar by bolts;

a pair of straight tread bars respectively slidable on top of said casters of said rear foot bar each having a second tubular means on front end pivoted to the second lug of said adjustment member by bolts and nuts with washers engaged therebetween and a pedal on top thereof;

a pair of support rods each having an aligned through hole adjacent lower end respectively pivoted to the first lug of said connecting bars and secured by bolts and nuts with washers engaged therebetween, a second transverse tube adjacent upper end respectively engaged with the transverse rod of said post and an opening in top thereof;

a pair of handle bars each having a reduced lower end secured to the opening of said support rods respectively;

a pair of positioning rods disposed on lateral sides of said idler wheel for positioning a magnet controlled resistance member which is adjustably controlled by a rope and a second swivel button on said post.

* * * * *